US006675932B2

(12) United States Patent
Manrique et al.

(10) Patent No.: US 6,675,932 B2
(45) Date of Patent: Jan. 13, 2004

(54) SPEAKER HOUSING CONFIGURED TO MINIMIZE STANDING WAVES AND RESONATE ABOVE THE FREQUENCY RANGE OF TRANSDUCERS

(75) Inventors: Pedro Manrique, Pasadena, CA (US); David Wathen, Los Angeles, CA (US)

(73) Assignee: Harman International Industries, Inc., Norhtridge, CA (US)

( * ) Notice: Subject to any disclaimer, the term of this patent is extended or adjusted under 35 U.S.C. 154(b) by 90 days.

(21) Appl. No.: 09/949,499

(22) Filed: Sep. 7, 2001

(65) Prior Publication Data

US 2003/0000768 A1 Jan. 2, 2003

Related U.S. Application Data

(60) Provisional application No. 60/302,830, filed on Jul. 2, 2001.

(51) Int. Cl.[7] ..... A47B 81/06; H04R 25/00; H04R 1/02; H04R 1/20

(52) U.S. Cl. ..... 181/199; 181/148; 181/155; 381/345; 381/352; 381/160

(58) Field of Search ..... 181/199, 148–156, 181/160, 30, 143; 381/345, 352, 160; D14/204, 214, 215, 216

(56) References Cited

U.S. PATENT DOCUMENTS

| | | | | | |
|---|---|---|---|---|---|
| 631,843 | A | | 8/1899 | Apthorp | |
| 2,010,806 | A | | 8/1935 | Best | 181/31 |
| 2,805,729 | A | | 9/1957 | Read | 181/31 |
| 2,847,722 | A | | 8/1958 | Wedeking | 20/1.12 |
| 3,217,366 | A | | 11/1965 | Wenger | 52/6 |
| 3,435,909 | A | | 4/1969 | Wenger et al. | 181/30 |
| 3,672,463 | A | | 6/1972 | Jafee et al. | 181/30 |
| 3,953,675 | A | * | 4/1976 | Babb | 181/198 |
| D269,871 | S | * | 7/1983 | Ishizaki | D14/214 |
| 4,424,881 | A | * | 1/1984 | Hattori | 181/155 |
| 4,640,381 | A | * | 2/1987 | Tsuchiya et al. | 181/199 |
| 4,650,031 | A | * | 3/1987 | Yamamoto | 181/156 |
| 4,872,527 | A | * | 10/1989 | Han | 181/160 |
| 4,891,842 | A | * | 1/1990 | Green | 381/392 |
| 4,928,787 | A | | 5/1990 | Kato | 181/141 |
| D350,135 | S | * | 8/1994 | Polk et al. | D14/204 |
| 5,640,461 | A | | 6/1997 | Ebert et al. | 381/188 |

FOREIGN PATENT DOCUMENTS

| | | | | |
|---|---|---|---|---|
| DE | 3248340 A1 | * | 12/1983 | H04R/1/02 |
| JP | 59230394 A | * | 12/1984 | H04R/1/02 |
| JP | 05183975 A | * | 7/1993 | H04R/1/02 |

* cited by examiner

*Primary Examiner*—Robert Nappi
*Assistant Examiner*—Edgardo San Martin
(74) *Attorney, Agent, or Firm*—Squire, Sanders & Dempsey, L.L.P.

(57) ABSTRACT

This invention provides a speaker enclosure that minimizes or defuses standing waves and minimizes resonance within the operating frequency range of its transducers. To minimize standing waves, the speaker enclosure has no two surfaces that are parallel to each other thus preventing the propagation of standing waves. The interior surface of the speaker enclosure may have ribs spaced apart on any surface that is prone to resonate so that the surface is strengthened such that it resonates at a predetermined frequency that is typically outside of the operating frequency range of the transducers.

21 Claims, 2 Drawing Sheets

SPEAKER HOUSING CONFIGURED TO MINIMIZE STANDING WAVES AND RESONATE ABOVE THE FREQUENCY RANGE OF TRANSDUCERS

CROSS-REFERENCES TO RELATED APPLICATIONS

This application is a non-provisional application claiming priority of U.S. provisional application Serial No. 60/302,830 filed Jul. 2, 2001.

BACKGROUND OF THE INVENTION

1. Field of the Invention

This invention generally relates to a speaker housing that minimizes standing waves and configured to resonate above an operating range of its transducers.

2. Related Art

In most loudspeaker systems, drivers or transducers are housed in a speaker enclosure. The speaker enclosure serves a number of functions. These functions include easier set up of transducers (or drivers) in one unit and keeping the transducers in the correct position while working together. At the same time, speaker enclosures often affect the quality of sound produced by the transducers. As the transducers vibrate the diaphragm, sound waves are emitted in the back and forth direction relative to the transducer. In other words, sound is produced behind the diaphragm as well as in front of the diaphragm. In a sealed enclosure, no air can escape and therefore back waves are trapped within the enclosure. Because no air can escape, the interior air pressure of the sealed enclosure changes as the diaphragm vibrates. With today's sealed enclosures, these back waves can significantly affect the quality of sound produced by the transducers.

One of the problems with back waves is that standing waves may be formed within the enclosure. For example, within rectangular-like box enclosures, there are a number of parallel surfaces, and as back waves emanate within the parallel surfaces, the standing waves simply propagate back and forth causing negative audible artifacts. The anomalies caused by standing waves are typically one-note based and are objectionable to the listener.

Another problem associated with back waves is viration of the waves against the sidewalls of the enclosure. Depending on the size and structural integrity of the sidewalls, the back waves may resonate at approximately the same operating frequency of the transducers. In such a case, the vibration of the sidewalls can interfere with the quality of sound produced by the transducer. Thus, the overall loudspeaker system may operate at less efficiency because some of the energy is used to vibrate the sidewalls instead of the diaphragm. Accordingly, there is still a need for a speaker enclosure that can minimize or defuse standing waves and prevent the enclosure from resonating within the operating frequency range of its transducers.

SUMMARY

This invention provides a speaker enclosure that minimizes or defuses standing waves and minimizes resonance within the operating frequency range of its transducers. This is accomplished by providing a speaker enclosure formed from a number of inner surfaces where no two surfaces are parallel with respect to another surface. In other words, none of the inner surfaces of the enclosure are parallel with respect to each other minimizing the propagation of standing waves. If standing waves do occur, they are diffused quickly by the elimination of parallel surfaces. Furthermore, a sidewall or inner surface that is prone to resonate within the operating frequency of its transducers may be strengthened, via ribs or any other methodologies known to one skilled in the art, to prevent that sidewall from vibrating.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
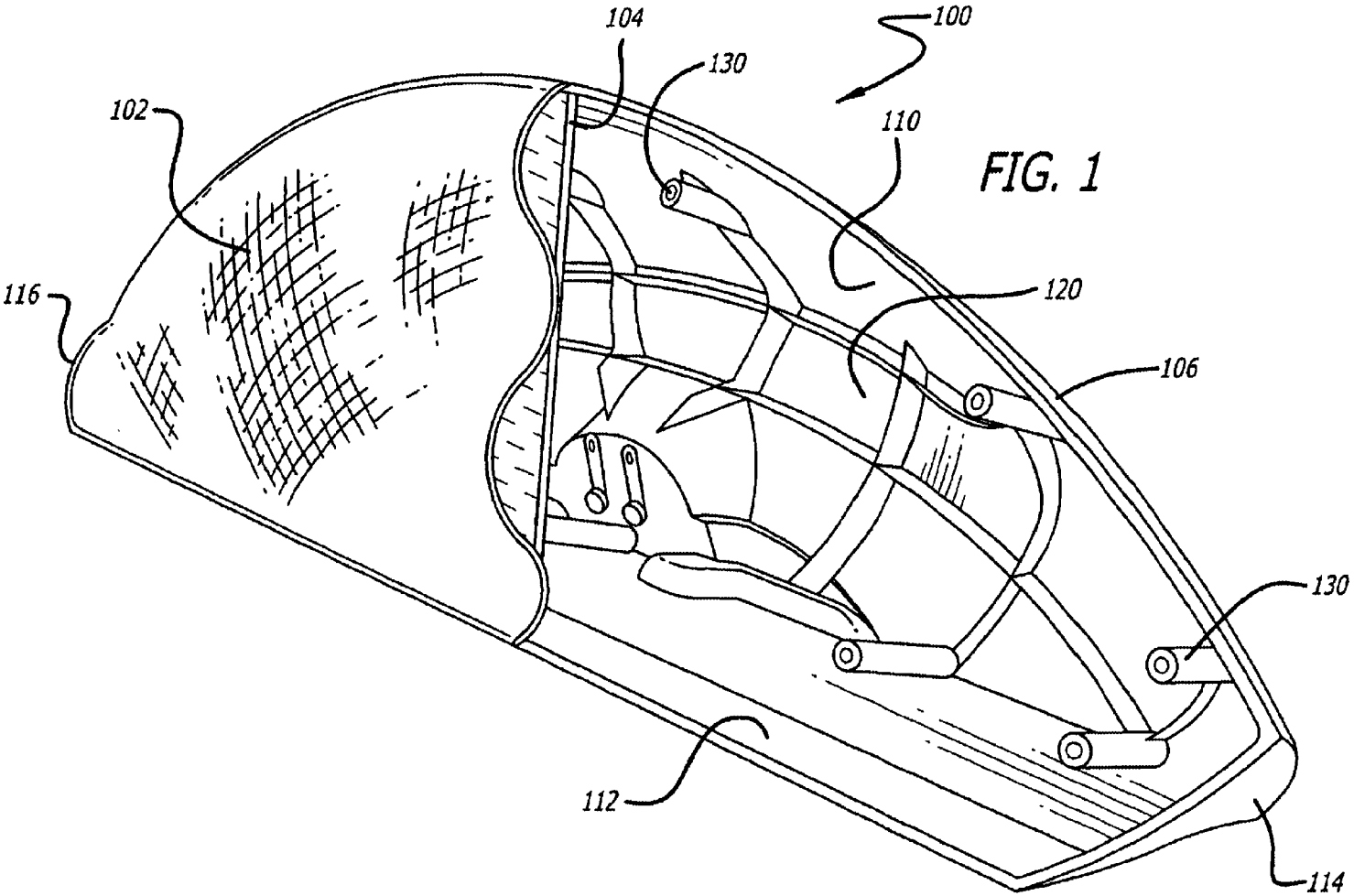
FIG. 1 is a perspective view of a speaker enclosure.

FIG. 1 illustrates a speaker enclosure 100 having a grill 102 covering a front cover 104 that is adapted to hold one or more transducers. The speaker enclosure 100 also includes a back cover 106 configured to enclose the transducers. To accomplish this, the back cover 106 may have a plurality of receptors 130 adapted to receive screws coupling the front cover 104 to the back cover 106. In this embodiment, the front cover 104 and the back cover 106 may form a sealed speaker enclosure 100. The transducers within the speaker enclosure 100 may be mid-range transducers, operating between 100 Hz and 2.5 KHz. The speaker enclosure, however, may also hold high frequency transducers that operate above 20 KHz, and low frequency transducers that operate below 300 Hz.

The back cover 106 may be formed of a plurality of sidewalls including a top surface 110 and an opposing base surface 112. The base surface 112 may be substantially planar so that the speaker enclosure 100 may rest on any flat surface such as a stand, table or above a television set. In contrast, the top surface 110 may be substantially curved, such as in the form of a dome shape. Thus, the two opposing surfaces 110, 112 may be structured in a non-parallel relationship with respect to each other. Moreover, two sidewalls 114, 116 may be substantially non-parallel with respect to each other as well, along with the top surface 110, and the base surface 112. In addition, the back surface 120 may also be structured with a non-parallel relationship with the front cover 104, along with the top surface 110, the base surface 112, and the two sidewalls 114 and 116, respectively.

By minimizing the number of parallel surfaces in the speaker enclosure 100, the back waves generated by the transducer may be prevented from propagating into standing waves. On the other hand, if some of the back waves do propagate into standing waves within the speaker enclosure 100, the standing waves may be quickly diffused without a pair of parallel walls causing the standing waves to bounce back and forth from within the speaker enclosure 100. Standing waves may cause audible artifacts in the loudspeaker system that may be propagated, in part, through the transducer. These artifacts may appear as dips and peaks in the loudspeaker system performance. Put differently, the standing waves within the speaker enclosure may interfere with the performance of the transducer so that sound does not seem natural as originally intended.

Another embodiment of the invention is to configure the speaker enclosure 100 so that it does not resonate within the operating frequency of the transducers. In general, all surfaces resonate. Typically, a larger, weaker surface wall will resonate at lower frequency than a smaller, stronger surface wall. For example, a 12-inch wide panel inside a speaker enclosure may resonate at 1 KHz. On the other hand, if a rib or stiffener is place at the center of the flat panel, the two 6 inch flat panel may resonate at 2 KHz. As flat panels are divided into smaller segments, they resonate at a higher frequency. Accordingly, the speaker enclosure 100 may be configured so that any surface that is prone to resonate in the operating frequency range of the transducer may be strengthen to increase its resonant frequency above the operating frequency of the transducers. This way, the speaker enclosure does not resonate to interfere with the quality of the sound produced by the complete loudspeaker system because the individual low frequency transducers are operating at a lower frequency range that does not resonate the speaker enclosure.

Figure 2:
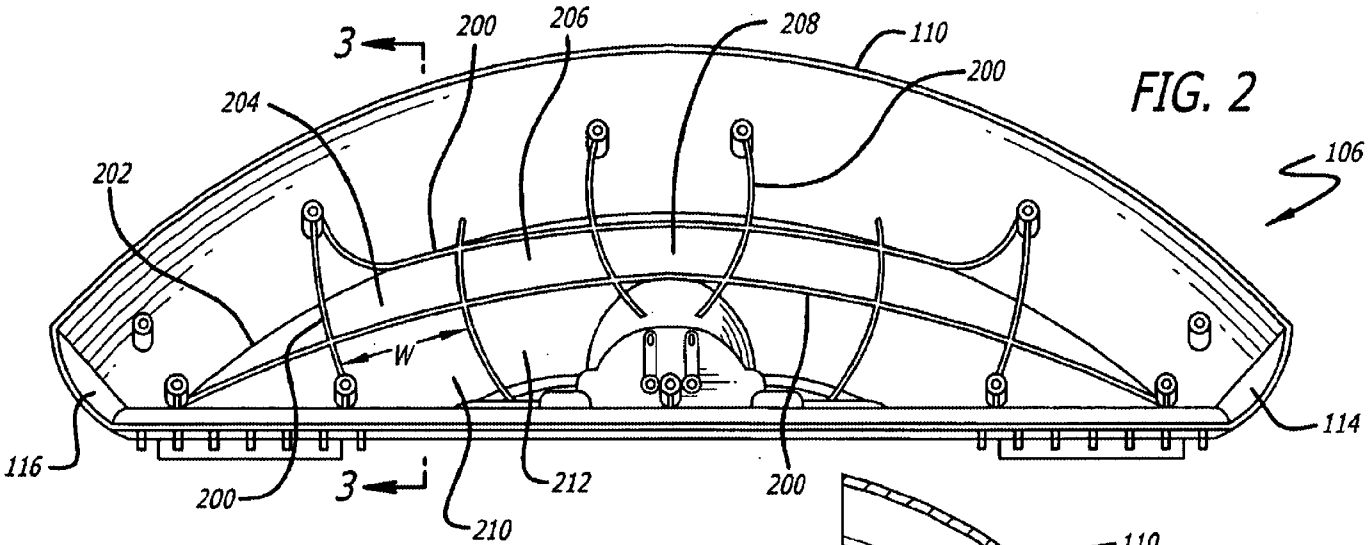
FIG. 2 is a front view of a speaker enclosure according to FIG. 1.
Figure 3:
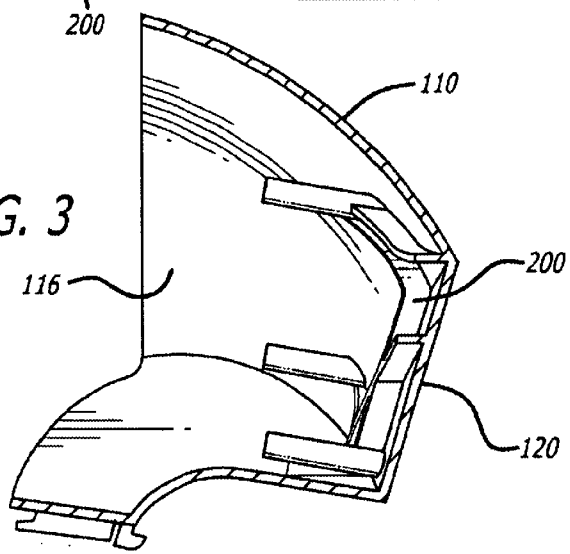
FIG. 3 is a cross-sectional view along the line 3—3 in FIG. 2 of the speaker enclosure illustrated in FIG. 1.

FIGS. 2 and 3 illustrate the back surface 120 having a substantially flat surface and about 0.4191 meters (16.5 inches) wide between the two sidewalls 114 and 116. This means that the back surface 120 may resonate when the wavelength of the back waves is about 0.4191 meters. As such, the frequency in which the back surface 120 may resonate may be based on the following where: Frequency= speed of sound/wavelength=345 (m/s)/0.4191 m=823 Hz. In one embodiment, the mid-range transducers in the speaker enclosure 100 may operate between about 100 Hz to about 2.5 KHz. Accordingly, the back waves from the mid-bass transducers may cause the back surface 120 to resonate around 823 Hz to interfere with the quality of the sound.

To prevent the back surface 120 from resonating within the operating frequency range of the transducers, a number of ribs or stiffeners 200 may be placed on the back surface 120 to divide the back surface 120 into smaller segments such as 200, 202, 204, 206, 208 and 210. That is, each of the segments are sized to resonate above the operating frequency of the transducer. For instance, the longest span between the ribs 200 may be in the segment 210, with a width "W" of about 0.0572 meters (2.25 inches). This means that the segment 210 may resonate when the wavelength is about 0.0572 meters. As such, the frequency in which the segment 210 may resonate may be about 6.036 KHz, based on the following where: Frequency=345 (m/s)/0.0572 m=6036 Hz or 6.036 KHz. Since the mid-bass transducers operate in the frequency range of between about 100 Hz and about 2.5 kHz, the segment 210 cannot resonate to interfere with the quality of the sound produced by the transducer. Likewise, since other segments in the back surface 120 are narrower than the segment 210, they too cannot resonate to interfere with the transducers.

To optimize the strength of the ribs 200, they may be curved rather than straight because curved ribs are stiffer than straight ribs. Mechanically, a flat surface bend and flex easier than a curved surface. As such, to further enhance the strength of the ribs 200 and consequently the back surface 120, the ribs 200 may be curved. Alternatively, ribs 200 may have any other configuration as known to one skilled in the art, including a straight rib.

Besides the back surface, the ribs 200 also extend to top surface 110 for added strength, but there may be less ribs 200 on the top surface 110 than on the back surface 120 for the following two reasons. First, the top surface 110 may be dome shape so that it is stiffer than a flat panel, such as the back surface 120. A flat surface bend and flex easier than a curved surface so that the top surface 110 may be less prone to resonate then the back surface 120. This means that the top surface 110 needs less ribs 200 then the back surface 120, if any. Secondly, top surface 110 having a dome shape is generally tangential to the direction of the back wave in comparison to the back surface 120. This means the back waves have less impact on the top surface 110 than on the back surface 120. With less impact on the top surface 110, the top surface 110 is less prone to resonate, and therefore less ribs 200 may be needed on the top surface 110 than on the back surface 120.

In this embodiment, the speaker enclosure 100 is designed to resonate above 6 KHz, which is more than twice the peak operating frequency range of the mid-bass transducer, i.e., 2.5 KHz. Alternatively, the speaker enclosure 100 may be configured to resonates just above the peak operating frequency range of the transducers such as 3 KHz. That is, the speaker enclosure 100 may be configured with ribs 200 spaced apart accordingly on any surface that is prone to resonate so that the speaker enclosure 100 resonate at a higher predetermined frequency than the operating frequency of the transducer. For example, for low-frequency range transducers that operate up to about 300 Hz, i.e., bass, the speaker enclosure 100 may be configured to resonate above 300 Hz. The speaker enclosure 100 may be configured to minimize standing waves and to resonate at a higher frequency to prevent the speaker enclosure from resonating within the operating frequency range of the transducer. This way, the enclosure does not resonate to interfere with the quality of the sound generated by the transducers.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A speaker enclosure capable of minimizing standing waves and resonance, comprising:

a front face coupled to a transducer having an operating frequency range of between about 100 Hz and about 2.5 KHz;

a rear cover enclosing the transducer and adapted to couple to the front face, the rear cover formed from a plurality of surfaces, where each of the surfaces is not parallel to any other surface, and where at least one of the plurality of surfaces is a substantially flat surface having a greater tendency to resonate than the other surfaces; and a plurality of ribs formed on the substantially flat surface to strengthen the flat surface and increase its resonant frequency to be greater than about 6.0 KHz.

2. The speaker enclosure according to claim 1, wherein at least a portion of the ribs is curved.

3. The speaker enclosure according to claim 1, wherein the rear cover completely seals the transducer.

4. A speaker enclosure, comprising:

a front face adapted to couple with a transducer; and a rear cover adapted to couple with the front face, where the rear cover encloses the transducer and has a plurality of non-parallel surfaces, where the plurality of surfaces include a top surface having a dome shape, wherein the transducer operates at a predetermined frequency range and the plurality of surfaces include a back surface that is substantially flat and has a plurality of ribs to increase its resonant frequency to be above the predetermined frequency range of the transducer, and wherein the plurality of ribs increase the resonant frequency of the back surface to about 6.0 KHz.

5. The speaker enclosure according to claim 4, wherein the plurality of surfaces include a top surface having a dome shaped surface and an opposing base surface having a flat shaped surface.

6. The speaker enclosure according to claim 4, wherein the plurality of surfaces include a flat shaped back surface opposing the front face.

7. The speaker enclosure according to claim 4, wherein the predetermined frequency range of the transducer is between about 100 Hz and about 2.5 KHz.

8. The speaker enclosure according to claim 4, wherein at least a portion of the plurality of ribs is curved.

9. The speaker enclosure according to claim 8, wherein the speaker enclosure is sealed.

10. A speaker enclosure, comprising:

means for diffusing standing waves within a sealed speaker enclosure by forming a top surface with a dome shape; and means for configuring the sealed speaker enclosure to resonate above about 6.0 KHz.

11. The speaker enclosure according to claim 10, wherein the sealed speaker enclosure is a plurality of surfaces that are substantially nonparallel with any other surface.

12. The speaker enclosure according to claim 11, wherein at least a portion of the plurality of surfaces is prone to resonate within the operating frequency range of the transducer.

13. The speaker enclosure according to claim 11, wherein at least a portion of the plurality of surfaces is strengthened to resonate above the operating frequency range of the transducer of between about 100 Hz and about 2.5 KHz.

14. A method for configuring a speaker, comprising:

enclosing a transducer having an operating frequency range, the enclosing having a plurality of surfaces which are substantially nonparallel to other surfaces to minimize occurrence of standing waves within the speaker enclosure, the plurality of surfaces having a resonating surface that is prone to resonate within the operating frequency of the transducer; and strengthening the resonating surface so that it resonates above about 6.0 KHz.

15. The method according to claim 14, further including curving at least a portion of the plurality of surfaces to strengthen that portion of the plurality of surfaces.

16. The method according to claim 14, wherein the strengthening is a plurality of ribs spaced apart along the resonating surface to divide the resonating surface to segments that resonates above the operating frequency of the transducer.

17. The method according to claim 16, wherein at least a portion of the plurality of ribs are curved to further strengthen the portion of the plurality of ribs.

18. A method according to claim 14, wherein the operating range of the transducer is between about 100 Hz and about 2.5 KHz.

19. A speaker enclosure capable of minimizing standing waves and resonance, comprising:

a front face coupled to a transducer having an operating frequency range of between about 100 Hz and about 2.5 KHz;

a rear cover enclosing the transducer and adapted to couple to the front face, the rear cover formed from a plurality of surfaces, where each of the surfaces is not parallel to any other surface, and where at least one of the plurality of surfaces is a substantially flat surface having a greater tendency to resonate than the other surfaces; and a plurality of ribs formed on the substantially flat surface to strengthen the flat surface and increase its resonant frequency to be greater than the operating frequency range of the transducer, where the plurality of ribs increase the resonant frequency of the back surface to about 6.0 KHz.

20. A speaker enclosure, comprising:

a front face adapted to couple with a transducer operating at a predetermined frequency range; and a rear cover adapted to couple with the front face and enclose the transducer, where the rear cover has a plurality of non-parallel surfaces including a back surface that is substantially flat and has a plurality of ribs to increase its resonant frequency to above about 6.0 KHz.

21. A speaker enclosure, comprising:

a front face adapted to couple with a transducer;

a rear cover adapted to couple with the front face, where the rear cover encloses the transducer and has a plurality of non-parallel surfaces, where the rear cover includes:

two side walls;

a back surface between the two side walls;

a top surface that is curved from one of the side walls to the other side wall, where the back surface is substantially flat and has a plurality of ribs to increase its resonant frequency to be about 6.0 KHz.

* * * * *